United States Patent [19]

Langen et al.

[11] 4,418,142

[45] Nov. 29, 1983

[54] LIGHT-SENSITIVE PHOTOGRAPHIC SILVER HALIDE RECORDING MATERIAL

[75] Inventors: Hans Langen, Bonn; Erich Wolff, Solingen; Erwin Ranz, Leverkusen, all of Fed. Rep. of Germany

[73] Assignee: Agfa Gevaert Aktiengesellschaft, Leverkusen, Fed. Rep. of Germany

[21] Appl. No.: 307,858

[22] Filed: Oct. 2, 1981

[30] Foreign Application Priority Data

Oct. 8, 1980 [DE] Fed. Rep. of Germany ..... 3037912

[51] Int. Cl.[3] ..... G03C 1/40; G03C 1/06

[52] U.S. Cl. ..... 430/549; 430/551; 430/543; 430/383; 430/623; 430/607; 430/611; 430/613; 430/614

[58] Field of Search ..... 430/623, 551, 601, 611, 430/613, 614, 621, 549, 383, 543

[56] References Cited

U.S. PATENT DOCUMENTS

| | | | |
|---|---|---|---|
| 3,447,926 | 6/1969 | Beckett et al. | 430/551 |
| 3,652,278 | 3/1972 | Asano et al. | 430/611 |
| 3,811,891 | 5/1974 | Darlak et al. | 430/621 |
| 4,063,952 | 12/1977 | Himmelmann et al. | 430/623 |

*Primary Examiner*—Won H. Louie, Jr.
*Attorney, Agent, or Firm*—Connolly and Hutz

[57] ABSTRACT

The light-sensitive color photographic silver halide recording material contains in at least one of its light-sensitive gelatine-containing layer, color formers for the formation of the image dyes in the three primary colors, a crosslinking agent activating the carboxyl groups of gelatine selected from carbamoylonium salts, carbamoylpyridinium salts and carbamoyloxypyridinium salts and a compound acting as aldehyde-scavenger which corresponds to the general formula wherein Z represents the atoms required for completing a 5-6-membered substituted or unsubstituted carbocyclic ring or a substituted or unsubstituted heterocyclic ring which may contain oxygen, nitrogen or sulfur as hetero-atom.

5 Claims, No Drawings

LIGHT-SENSITIVE PHOTOGRAPHIC SILVER HALIDE RECORDING MATERIAL

This invention relates to a photographic silver halide recording material containing a compound capable of reacting as aldehyde-scavenger in addition to a cross-linking agent which activates the carboxyl groups of the gelatine used as binder.

Photographic recording materials normally consist of a layer support to which are applied light-sensitive silver halide emulsion layers containing gelatine and/or light-sensitive auxiliary layers, also containing gelatine. The light-sensitive silver halide gelatine emulsion layers of color photographic recording materials contain the color components required for formation of the image dyes in the three primary colors The multilayered recording materials mentioned here which are used in black-and-white photography, as well as color photography and the methods of preparing them are well known and have been described in, for example, Ullmanns Enzyklopadie der technischen Chemie, 4th Edition, Volumn 18, in the Chapter entitled "Photography".

Since the gelatine layers of which the photographic recording material is composed must not undergo undue swelling in the course of processing and must have sufficient mechanical strength in order not to be damaged, they are treated with cross-linking agents, also known as hardeners. The substances used as hardeners include both inorganic and organic compounds which are photographically inert and capable of cross-linking gelatine via the carboxyl groups or the amino groups. Examples of known hardeners include aldehydes, e.g., formaldehyde, glyoxal and glutaraldehyde, aldehydic acids, e.g. mucochloric acid, diketones, e.g. diacetyl, dihalides, e.g. 1,3-dichloropropanol, bis-vinylsulfone compounds, diisocyanate bisulfite compounds, bis-epoxides, bis-acrydines, peptide reagents, such as carbodiimides, N-carbamoylpyridinium salts and isoxazolinum salts, and substituted, 2,4-dichlorotriazines, e.g. N,N',N''-tris-acryloyl-perhydro-s-triazine.

It is known that the use as hardeners of the above-mentioned aldehydes, such as formaldehyde, glyoxal, glutaraldehyde or succinaldehyde, entails certain difficulties not only in that the degree of cross-linking of the gelatine layers by such aldehydes is difficult to limit, but also in that these aldehydes are liable to impair the function of the color components contained in the layers and give rise to fogging. This disadvantageous effect may be expected not only if the aldehydes have been deliberately incorporated in the photographic materials, but also if, for example, the photographic materials are unintentionally stored in an atmosphere containing aldehydes so that the aldehydes penetrate the photographic layers. This situation may occur when photographic materials are stored in furniture manufactured from plywood which has been glued with an adhesive containing formalin, e.g. a melamine/formaldehyde resin or a phenol/formaldehyde resin. If photographic material is stored in such furniture, the formaldehyde from the glue may cause substantial fogging of the photographic layers, which would invariably impair the quality of photographic images produced with such material. In the case of a color photographic material, the loss in quality due to the effect of aldehydes will be even more marked because the gamma balance of the three emulsion layers producing the color image will then also be impaired.

It has been attempted to obviate the above-described disadvantages of using aldehydes by incorporating so-called "aldehyde-scavengers" in the photographic material, that is to say compounds which are capable of trapping the aldehyde.

According to German Offenlegungsschrift No. 1,772,816 for example, compounds, such as N,N'-ethylene-urea, 2,3-dihydroxynaphthalene or dimedon, are added to the photographic layers to fix formaldehyde. German Offenlegungsschrift No. 2,332,426 describes a photographic recording material in which one colloid layer contains an acyclic urea as aldehyde-scavenger in addition to a vinyl sulfonyl hardener. U.S. Pat. No. 3,652,278 relates to a process for reducing the fog in photographic materials which are to be stored in an atmosphere containing formaldehyde. In this process, a compound selected from N,N'-ethylene urea, 2,3-dihydroxynaphthalene and 1,1-dimethyl-3,5-diketocyclohexane is incorporated in the silver halide emulsion of the material.

According to U.S. Pat. No. 2,309,492, photographic materials which contain an aldehyde hardener are processed in the presence of an organic compound which is capable of reacting with the aldehyde. The organic compounds which may be used for this purpose include hydroxylamines, hydrazines, hydrazo compounds, semicarbazides, naphthalene diamines and dimethyldihydroresorcinol. U.S. Pat. No. 3,168,400 also relates to a process for the stabilisation of photographic images. It consists in hardening the binder of the photographic material with an aldehyde before it is developed and after exposure and then removing the unused aldehyde by treatment with an aqueous solution of an amine compound. Suitable amines include, for example, hydroxylamine, semicarbazide, hydrazine, biuret, aminoguanidine, etc. According to German Offenlegungsschrift No. 2,227,144, photographic materials containing aldehydes are treated in baths containing hydroxylamine or a water-soluble salt of hydroxylamine and an aromatic polyhydroxyl compound having two hydroxyl groups in the ortho-position, e.g. and o-dihydroxy compound of the benzene series.

None of these measures is capable of satisfactorily preventing the damage to a photographic material caused by the above-described action of aldehydes.

It is an object of the present invention to develop a photographic recording material which is protected against fogging, in particular when exposed to the action of aldehyde under conditions of prolonged storage, and in which the contrast and sensitivity are not deleteriously affected by its storage under such conditions.

This problem is solved according to the present invention by means of a light-sensitive photographic silver halide recording material consisting of a layer support to which is applied at least one light-sensitive gelatine-containing layer which also contains a cross-linking agent activating the carboxyl groups of gelatine and a compound acting as aldehyde-scavenger. The material according to the present invention is characterised in that the cross-linking agent which activates the carboxyl groups of gelatine is a gelatine hardener selected from carbamoylonium salts, carbamoylpyridinum salts and carbamoyloxypyridinium salts, while the compound acting as aldehyde-scavenger corresponds to the following general formula:

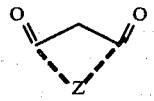

wherein Z represents the atoms required for completing a 5- or 6-membered substituted or unsubstituted carbocyclic ring or a substituted or unsubstituted heterocyclic ring which may contain oxygen, nitrogen, or sulfur as hetero-atom.

The compounds acting as aldehyde-scavengers according to the present invention are selected from cyclopentane-1,3-diones, cyclohexane-1,3-diones, pyran-2,4-diones, dihydropyran-2,4-diones, thiopyran-2,4-diones, dioxo-cyclo-hexane-2,4-diones, tetrahydropyrimidine-2,4-diones and 2,4,6-trioxo-hexahydropyrimidines, in any of which compounds the ring carbon atoms may be substituted with straight- or branched-chain alkyl groups having from 1 to 5 carbon atoms or may carry a condensed cycloaliphatic or aromatic 6-membered ring or an aliphatic 5- or 6-membered ring in spiro-linkage, and the total number of carbon atoms of the substituents is not greater than 6.

It has surprisingly been found that color photographic recording materials in which the gelatine layers have been hardened with a hardener selected from carbamoylonium salts, carbamoylpyridinium salts and carbamoyloxypyridinium salts and in addition contain one of the diketo compounds according to the present invention are substantially immune to the damaging effects of aldehydes. This applies in particular to color photographic layers containing magenta-4-equivalent couplers, such as those described for example, in German Offenlegungsschrift Nos. 2,015,867 and 2,408,665 and U.S. Pat. No. 3,062,653.

The following compounds are typical examples of cyclic diketo compounds according to the present invention.

| | |
|---|---|
| (A) | |
| Cycloalkane-1,3-dione compounds | |
| 1. Cyclohexane-1,3-dione | (104° C.) |
| 2. 1,1-Dimethyl-cyclopentane-2,4-dione | (97° C.) |
| 3. 1,1-Dimethyl-cyclohexane-3,5-dione | (147° C.) |
| 4. 1-Ethyl-cyclohexane-2,4-dione | (109° C.) |
| 5. 1,1-Diethyl-cyclohexane-3,5-dione | (113° C.) |
| 6. Spiro[4,5]decane-7,9-dione | (135° C.) |
| (B) | |
| Pyran-2,4-dione compounds | |
| 7. 6-Methyl-pyran-2,4-dione | (189–190° C.) |
| 8. 6-Ethyl-pyran-2,4-dione | (107° C.) |
| 9. 6-Isopropyl-pyran-2,4-dione | (86° C.) |
| 10. 6-(n)-butyl-pyran-2,4-dione | (58° C.) |
| 11. 6-Isobutyl-pyran-2,4-dione | (106–107° C.) |
| 12. 6-Pentyl-pyran-2,4-dione | (46–47° C.) |
| 13. 6-Isopentyl-pyran-2,4-dione | (53–55° C.) |
| 14. 6,7-Dihydro-5H—cyclopentane[b]pyran-2,4-dione | (188° C.) |
| 15. 5,6,7,8-Tetrahydro-chroman-2,4-dione | (222° C.) |
| 16. Chroman-2,4-dione | (213–215° C.) |
| (C) | |
| Thiopyran-dione compounds | |
| 17. Thiochroman-2,4-dione | (211° C.) |
| (D) | |
| Dihydropyran-2,4-dione compounds | |
| 18. 6-Trans-propenyl-dihydro-pyran-2,4-dione | (120–122° C.) |
| 19. 1-Oxaspiro-[5,5]-undecane-2,4-dione | (121–123° C.) |
| (E) | |
| Dioxa-cycloalkane-2,4-dione compounds | |
| 20. 2,2-Dimethyl-[1,3]-dioxane-4,6-dione | (96–97° C.) |
| 21. 2,2-Dipropyl-[1,3]-dioxane-4,6-dione | (89° C.) |
| 22. 2-Phenyl-[1,3]-dioxane-4,6-dione | (148° C.) |

-continued

| | |
|---|---|
| 23. 6,10-Dioxa-spiro-[4,5]-decane-7,9-dione | (72° C.) |
| 24. 1,5-Dioxa-spiro-[5,5]-undecane-2,4-dione | (95° C.) |
| (F) | |
| Tetrahydropyrimidine-2,4-dione compounds | |
| 25. 2,4,6-Trioxo-hexahydropyrimidine | (decomposition) |
| 26. 1-Methyl-2,4,6-trioxo-hexahydropyrimidine | (305° C.) |
| 27. 1,5-Dimethyl-2,4,6-trioxohexahydropyrimidine | (123° C.) |
| 28. 1-Ethyl-2,4,6-trioxo-hexahydropyrimidine | (119–120° C.) |
| 29. 1-Phenyl-2,4,6-trioxo-hexahydropyrimidine | (262° C.) |

The compounds used according to the present invention may be prepared by methods known from the literature. The following literature references may be used for the various classes of compounds:

COMPOUND CLASS A

Compounds 1 and 3:

By catalytic hydrogenation of the corresponding resorcinol or ethylrescorcinol, N. L. Drake, G. F. Woods and J. W. Tucker, Org. Synth., Coll. Vol. III, 278 and D.R.P. 21915.

Compounds 2 and 6:

By intramolecular condensation of $\beta,\beta$-dimethyl-laevulinic acid or 1-acetonyl-cyclopentane-acetic acid-(1)-methyl ester with sodium methylate, E. Rothstein and J. F. Thorpe, J. Chem. Soc. (London), 1926, 2011 and M. Qudrat-J-Kuda, J. Chem. Soc. (London), 1929, 713.

Compound 5:

By Michael-addition of mesityl oxide or 3-ethyl-3-hexen-5-one with sodium malonic ester, followed by alkaline hydrolysis, R. L. Schriner and H. R. Todd, Org. Synth., Coll. Vol. II, 200 and G. A. R. Kon and R. P. Linstead, J. Chem. Soc. (London), 127, 815 (1925).

COMPOUND CLASSES B AND C

Compounds 7 to 13:

By treatment of dehydracetic or higher homologues thereof with 90% $H_2SO_4$, see J. N. Collie, J. Chem. Soc. (London), 59, 607 (1891) and F. Kögl and C. A. Salemink, Rcl. Trav. Chim. Pays-Bas 71, 779 (1952).

Compounds 14 and 15:

By treatment of 3-benzyl-4-hydroxy-5,6-trimethylene-2-pyrone (from cyclopentanone and benzyl malonic acid-bis-(2,4-dichlorophenol)-ester) or 3-benzyl-4-hydroxy-5,6-tetramethylene-2-pyrone with $AlCl_3$ in the heat, see E. Ziegler, H. Junek and E. Nölken, Monatsh. Chem. 89, 678 (1958).

Compounds 16 and 17:

By cyclisation of malonic acid diphenyl ester or malonic acid dithiophenyl ester with $AlCl_3$, see E. Ziegler and H. Junek, Monatsh. Chem. 86, 29 (1955).

COMPOUND CLASS D

Compound 18:

From 4-hydroxy-hept-5-en-1-yne-1-carboxylic acid and piperidine in ether, see H. B. Heubert, E. R. H. Jones, J. Chem. Soc. (London) 1950, 3268.

Compound 19:

By ether splitting of 5,6-dihydro-4-methoxy-6,6-pentamethylene-2-pyrone, see H. B. Heubert loc cit.

COMPOUND CLASS E

Compounds 20, 21, 23 and 24:

By the condensation of acetone or of a higher ketone (heptanone-4 cyclopentanone, cyclohexanone) with malonic acid in the presence of acetic acid anhydride and sulfuric acid, see D. Davidson and S. A. Bernhard, J. Amer. Chem. Soc. 70, 3426 (1948), A. Kandiah, J. Chem. Soc. (London) 1932, 1212, and R. Eistert and F. Geiss, Chem, Ber. 94, (1961).

Compound 22

By the treatment of malonic acid with acetic acid anhydride and sulfuric acid, removal of the resulting acetic acid and reaction with benzaldehyde, see A. Micheal and N. Weiner, J. Amer. Chem. Soc. 58. 680 (1936).

COMPOUND CLASS F

Compounds 25 to 29

By condensation of a urea with malonic acid in the presence of acetic acid anhydride or $POCl_3$, see A. H. Biltz and H. Wittek, Ber. dt. Chem. Ges. 1036 (1929) and M. Conradt and M. Guthzeit, Ber. dt. Chem. Ges. 14, 1643 (1881) and J. B. Dickey and A. R. Gray, Org. Synth. Coll. Vol. II page 60.

The hardeners used according to the present invention in conjuction with the cyclic diketone compounds belong to the group carbamoylonium salts, carbamoylpyridinium salts and carbamoyloxypyridinium salts. Examples of suitable hardeners from these groups include compounds corresponding to the following general formulae:

(I) Carbamoylonium compounds corresponding to the following general formula:

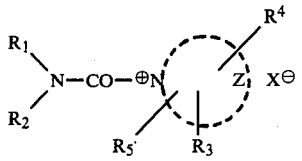

wherein $R_1$ represents a substituted or unsubstituted alkyl group, in particular one having from 1 to 3 carbon atoms, an aryl group optionally substituted with a lower alkyl group or with halogen, e.g. phenyl, optionally substituted with methyl, ethyl or propyl, Cl or Br, or an aralkyl group, e.g. benzyl, which may be substituted in the same manner as the aryl group;

$R_2$ has the same meaning as $R_1$ or represents a double bonded, optionally substituted alkylene, arylene, aralkylene or alkyl-aryl-alkyl group, e.g. an ethylene, propylene, phenylene or xylylene group, which is attached by its second bond to another carbamoylonium group corresponding to the following general formula:

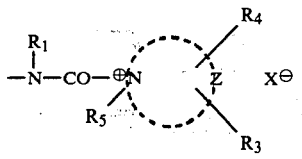

or $R_1$ and $R_2$ together constitute the atoms required for completing a substituted or unsubstituted piperidine, piperazine or morpholine ring which may be substituted, e.g., with an alkyl group having from 1 to 3 carbon atoms or with a halogen, such as Cl or Br;

$R_3$ represents a hydrogen atom, an alkyl group having from 1 to 3 carbon atoms or the group $\overline{A}_\alpha$ wherein A represents a vinyl group or a polymerized vinyl compound or a copolymer with other copolymerisable monomers and $\alpha$ represents a number such that the molecular weight of the compound is greater than 1000;

$R_4$ represents a hydrogen atom or an alkyl group having from 1 to 3 carbon atoms, or when Z represents the atoms required for completing a pyridinium ring and $R_3$ is absent, $R_4$ represents one of the following groups:

| | |
|---|---|
| $-NR^6-CO-R^7$ | $R^6$ = H, alkyl (1-4 C)<br>$R^7$ = H, alkyl (1-4 C),<br>= $NR^8R^9$ wherein<br>$R^8$, $R^9$ = H, alkyl ($C_1$-$C_4$) |
| $-(CH_2)_m-NR^{10}R^{11}$ | $R^{10}$ = $-CO-R^{12}$<br>$R^{11}$ = H, alkyl ($C_1$-$C_4$)<br>$R^{12}$ = H, alkyl ($C_1$-$C_4$)<br>$R^{12}$ = $NR^{13}R^{14}$<br>$R^{13}$ = alkyl ($C_1$-$C_4$), aryl<br>$R^{14}$ = H, alkyl, aryl<br>m = 1-3 |
| $-(CH_2)_n-CONR^{15}R^{16}$ | $R^{15}$ = H, alkyl ($C_1$-$C_4$), aryl<br>$R^{16}$ = H, alkyl ($C_1$-$C_4$) or<br>$R^{15}$ and $R^{16}$ together constitute the atoms required for completing a 5- or 6-membered aliphatic ring,<br>n = 0 to 3 |
| $(-CH_2)_p-CH(Y)-R^{17}$, $Y-R^{18}$ | $R^{17}$ = H or alkyl ($C_1$-$C_4$) optionally substituted by halogen,<br>Y = $-O-$, $-NR^{19}-$,<br>$R^{18}$ = H, alkyl, $-CO-R^{20}$, $-CO-NHR^{21}$<br>$R^{19}$, $R^{20}$, $R^{21}$ = H, alkyl, ($C_1$-$C_4$),<br>p = 2 or 3, |

$R_5$ represents alkyl, aryl or aralkyl, but is absent if the nitrogen atom to which $R^5$ would be attached carries a double bond in the heterocyclic aromatic ring formed by Z;

Z represents the atoms required for completing a substituted or unsubstituted 5- or 6-membered heterocyclic aromatic ring or a condensed system, such as isoquinoline, which atoms may in addition to the nitrogen atom contain other heteroatoms, e.g. O and S; and X represents an anion, e.g. halogen$^\ominus$, $BF_4^\ominus$, $NO_3^\ominus$, $SO_4^{\ominus\ominus}$, $ClO_4^\ominus$ or $CH_3OSO_3^\ominus$.

(II) Carbamoylpyridinium compounds corresponding to the following general formula:

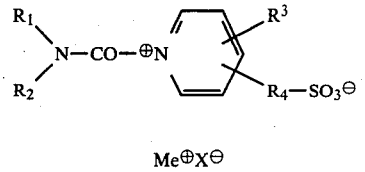

$Me^\oplus X^\ominus$ wherein $R_1$ and $R_2$, which may be the same or different, represent an alkyl group having from 1 to 3 carbon atoms, an aryl group optionally substituted with a lower alkyl group or with halogen, e.g. phenyl optionally substituted with methyl, ethyl, Cl or Br, or an aralkyl group, such as benzyl, which may be substituted in the same manner as the aryl group; or $R_1$ and $R_2$ together constitute the atoms required for completing a piperidine or morpholine ring which may be substituted with alkyl, e.g. methyl or ethyl, or with halogen, e.g. Cl or Br;

$R_3$ represents hydrogen, methyl or ethyl;

$R_4$ represents methylene, ethylene, propylene or a single bond;

$Me^{\oplus}$ represents an alkali metal cation, such as $Li^{\oplus}$, $Na^{\oplus}$ or $K^{\oplus}$; and $X^{\ominus}$ represents an anion, such as $Cl^-$ or $Br^-$.

(III) Carbamoyloxypyridinium compounds corresponding to the following general formula:

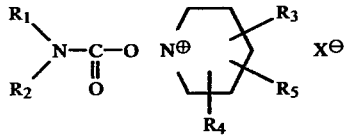

wherein $R_1$ represents alkyl having from 1 to 3 carbon atoms or aryl, such as phenyl;

$R_2$ represents alkyl having from 1 to 3 carbon atoms or the group:

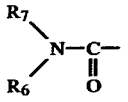

wherein $R_7$ represents hydrogen or an alkyl group, such as methyl or ethyl; and $R_6$ represents an alkyl group, such as methyl or ethyl; or $R_1$ and $R_2$ together constitute the atoms required to complete a heterocyclic ring system, such as a pyrrolidine, morpholine, piperidine, perhydroazepine, 1,2,3,4-tetrahydroquinoline or imidazolidine-2-OH ring; or $R_1$ and $R_2$ together constitute the atoms required for completing a piperazine ring in which the second nitrogen atom establishes the connection to a similar second molecular grouping corresponding to the general formula;

$R_3$ represents hydrogen, halogen, such as Cl and Br, alkyl, such as methyl and ethyl, hydroxyalkyl having from 1 to 3 carbon atoms, cyano, $—CONH_2$ or NH—C—O— alkyl (such as methyl or ethyl);

$R_4$ represents hydrogen or alkyl, such as methyl or ethyl;

$R_5$ represents hydrogen or methyl; and

X represents an anion, such as Cl, $BF_4$, or $ClO_4$.

The following compounds are given as examples of hardeners which may advantageously be used according to the present invention:

I/1.

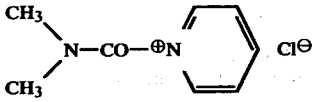

Syrup, highly hygroscopic.

-continued

I/2.

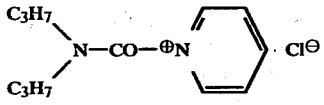

Syrup, highly hygroscopic.

I/3.

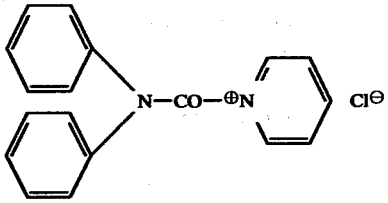

m.pt. 112° C.

I/4.

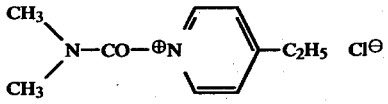

m.pt. 103° C.

I/5.

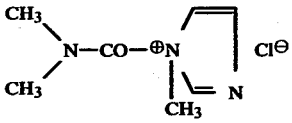

m.pt. 87–89° C.

I/6.

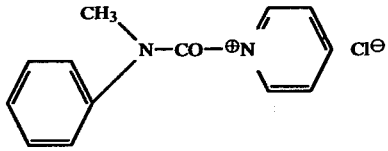

m.pt. 108–110° C.

I/7.

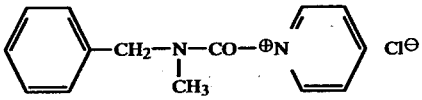

Syrup, highly hygroscopic.

I/8.

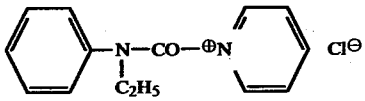

m.pt. 105–107° C.

I/9.

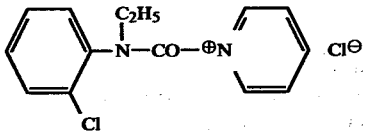

Syrup

I/10.

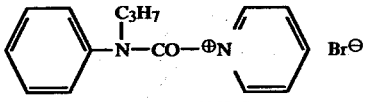

m.pt. 103–105° C.

I/11.

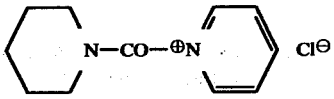

m.pt. 75–77° C.

-continued
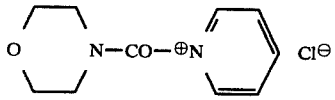
m.pt. 110–112° C.
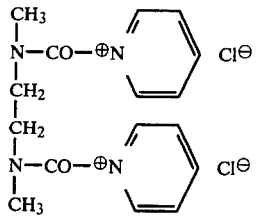
m.pt. 95–96° C.
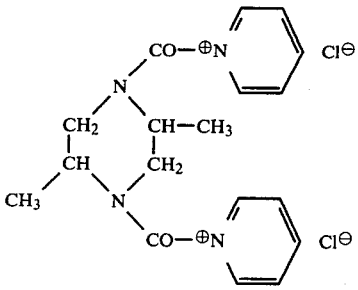
m.pt. 106° C.
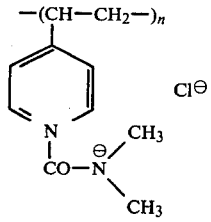
molecular weight above 1000
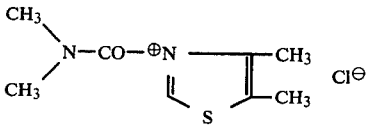
m.pt. 66–68° C.
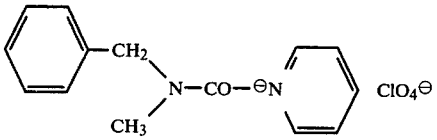
Syrup, hygroscopic
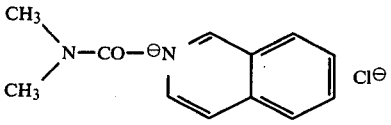
oil
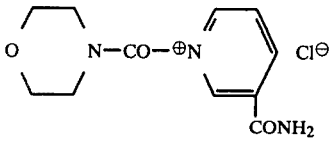
m.pt. 103–105° C.
-continued
I/12.
I/13.
I/14.
I/15.
I/16.
I/17.
I/18.
I/19.
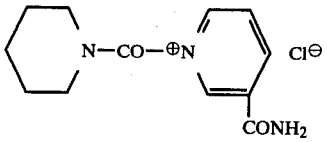
oil
I/20.
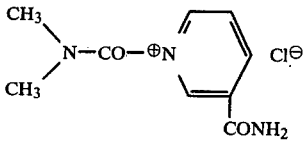
m.pt. 109° C.
I/21.
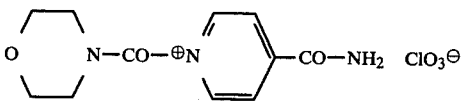
I/22.
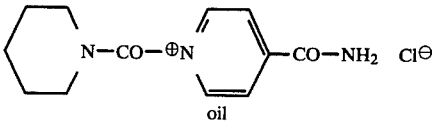
oil
I/23.
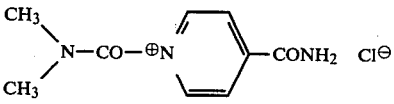
m.pt. 115° C.
I/24.
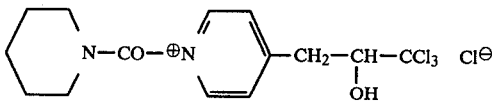
m.pt. 154° C.
I/25.
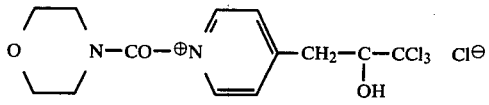
m.pt. 140° C.
I/26.
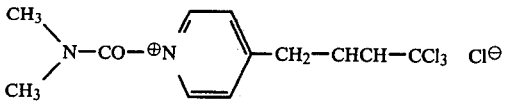
m.pt. 115° C.
I/27.
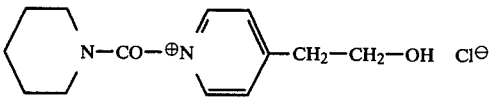
I/28.
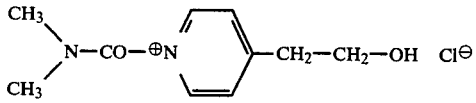
m.pt. 140–145° C.
I/29.
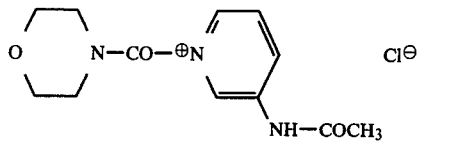
m.pt. 118–120° C.
I/30.

-continued
I/31.
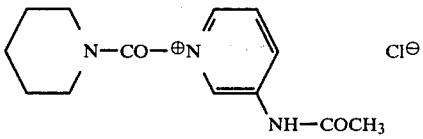
m.pt. 90° C.
I/32.
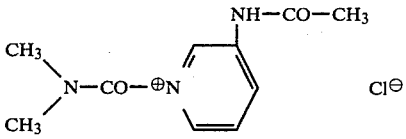
m.pt. 210° C.
I/33.
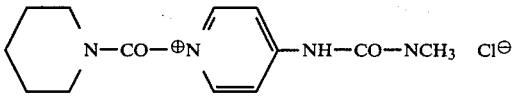
oil
I/34.
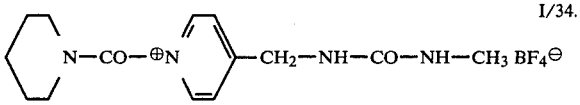
oil
I/35.
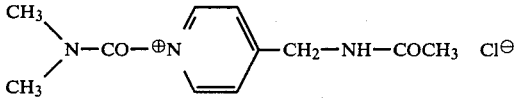
oil
I/36.
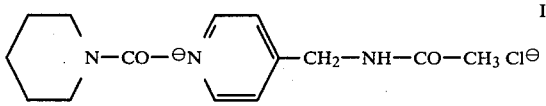
oil
I/37.
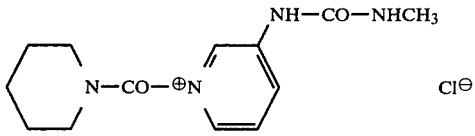
m.pt. 60-65° C.
I/38.
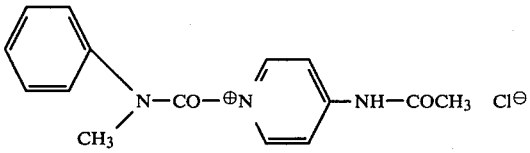
I/39.
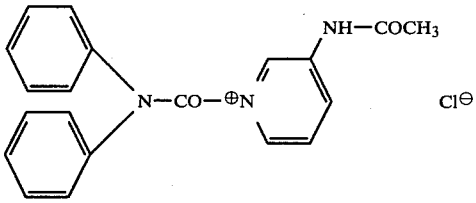
-continued
I/40.
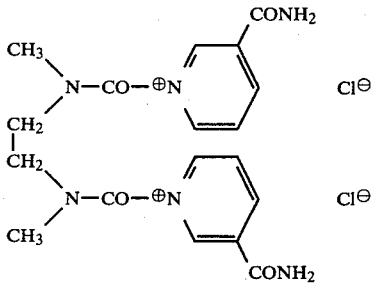
Compounds corresponding to general formula II.
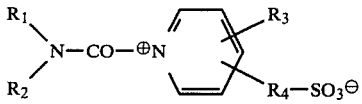
II/1.
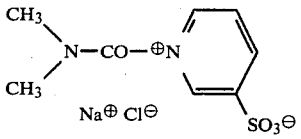
II/2.
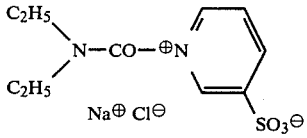
II/3.
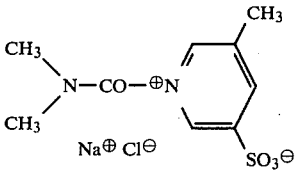
II/4.
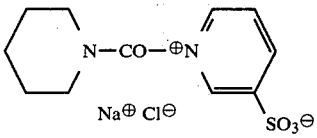
II/5.
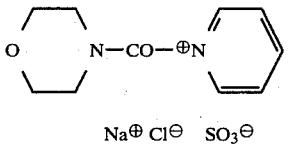
II/6.
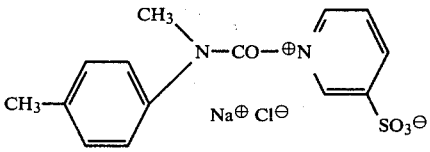
II/7.
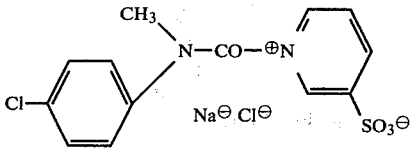

-continued
II/8.
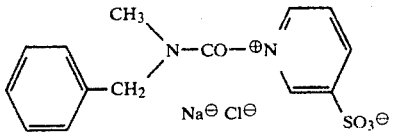
II/9.
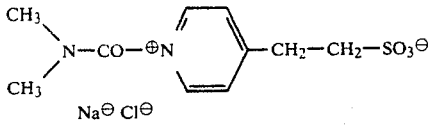
II/10.
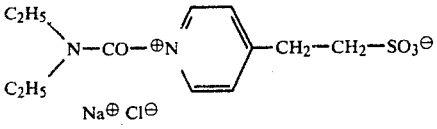
II/11.
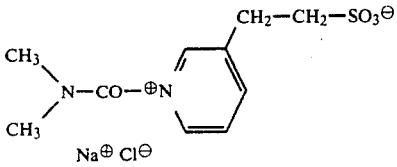
II/12.
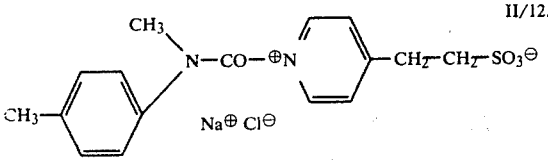
-continued
II/13.
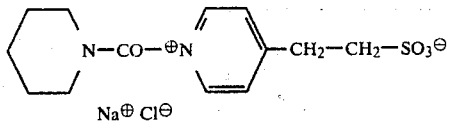
II/14.
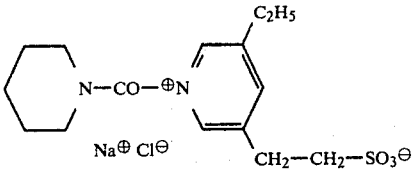
II/15.
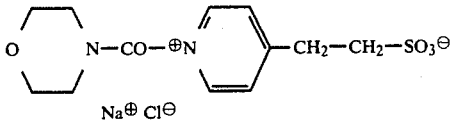
II/16.
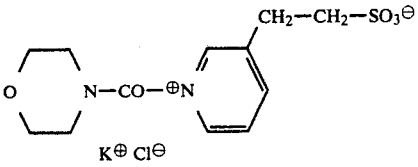
II/17.
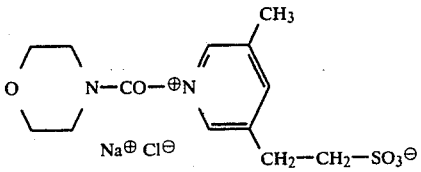
Compounds corresponding to general formula III
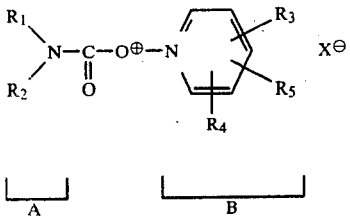
| subst.-No. | A | B | $X^{\ominus}$ | m.pt. decomp. |
|---|---|---|---|---|
| III/1. | 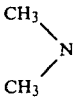 | 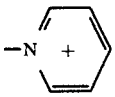 | $Cl^{\ominus}$ | 163-67° C. |
| III/2. | " | 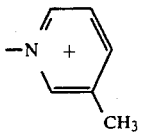 | $Cl^{\ominus}$ | 168-70° C. |
| III/3. | " | 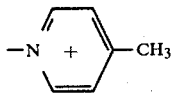 | $Cl^{\ominus}$ | 86° C. |

-continued
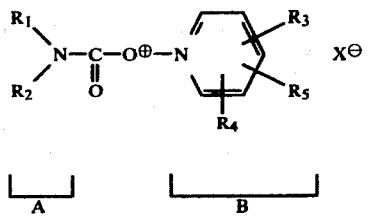
| subst.-No. | A | B | $X^{\ominus}$ | m.pt. decomp. |
|---|---|---|---|---|
| III/4. | " | 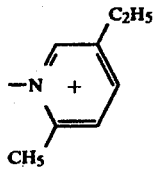 | $Cl^{\ominus}$ | 90° C. |
| III/5. | " | 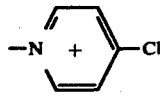 | $ClO_4^{\ominus}$ | 100–102° C. |
| III/6. | " | 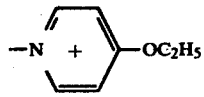 | $ClO_4^{\ominus}$ | 95–100° C. |
| III/7. | " | 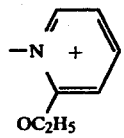 | $ClO_4^{\ominus}$ | 100–102° C. |
| III/8. | " | 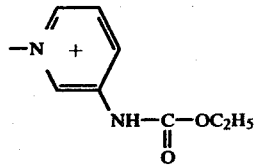 | $ClO_4^{\ominus}$ | 150° C. |
| III/9. | 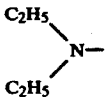 | 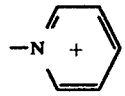 | $Cl^{\ominus}$ | 108–110° C. |
| III/10. | " | 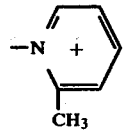 | $ClO_4^{\ominus}$ | 64–65° C. |
| III/11. | " | 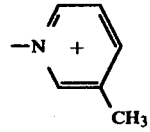 | $ClO_4^{\ominus}$ | 130–132° C. |
| III/12. | " | 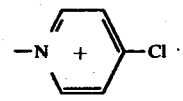 | $Cl^{\ominus}$ | 95–100° C. |

-continued
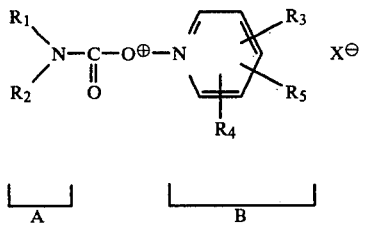
| subst.-No. | A | B | $X^{\ominus}$ | m.pt. decomp. |
|---|---|---|---|---|
| III/13. | 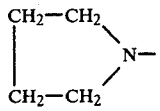 | 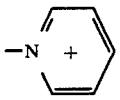 | $Cl^{\ominus}$ | 114–113° C. |
| III/14. | " | 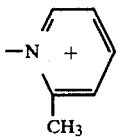 | $Cl^{\ominus}$ | 90–92° C. |
| III/15. | 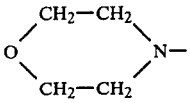 | 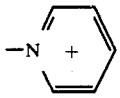 | $Cl^{\ominus}$ | 132° C. |
| III/16. | " | " | $BF_4^{\ominus}$ | 138–140° C. |
| III/17. | " | " | $ClO_4^{\ominus}$ | 150–152° C. |
| III/18. | " | 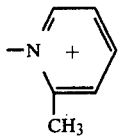 | $Cl^{\ominus}$ | 110–113° C. |
| III/19. | " | " | $ClO_4^{\ominus}$ | 140–142° C. |
| III/20. | " | 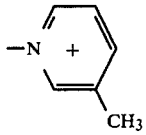 | $Cl^{\ominus}$ | 130–132° C. |
| III/21. | " | " | $ClO_4^{\ominus}$ | 144–146° C. |
| III/22. | 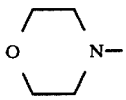 | 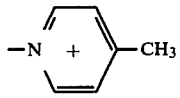 | $Cl^{\ominus}$ | >90° C. |
| III/23. | " | 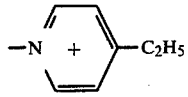 | $Cl^{\ominus}$ | 100–102° C. |
| III/24. | " | 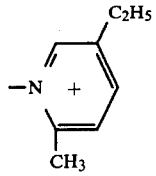 | $Cl^{\ominus}$ | 102–104° C. |

-continued
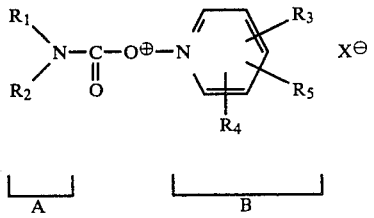
| subst.-No. | A | B | $X^{\ominus}$ | m.pt. decomp. |
|---|---|---|---|---|
| III/25. | " | 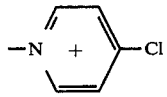 | $Cl^{\ominus}$ | 100–102° C. |
| III/26. | " | 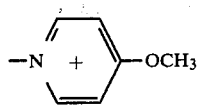 | $Cl^{\ominus}$ | 113–115° C. |
| III/27. | " | 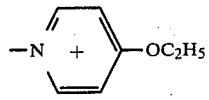 | $Cl^{\ominus}$ | >115° C. |
| III/28. | " | 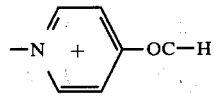 | $ClO_4^{\ominus}$ | 112–114° C. |
| III/29. | " | 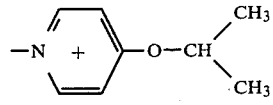 | $Cl^{\ominus}$ | 93–95° C. |
| III/30. | " | 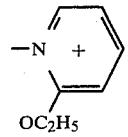 | $Cl^{\ominus}$ | 65–70° C. |
| III/31. | " | " | $BF_4^{\ominus}$ | 144–148° C. |
| III/32. | " | 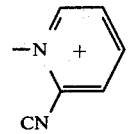 | $Cl^{\ominus}$ | 80–82° C. |
| III/33. | " | 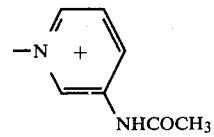 | $ClO_4^{\ominus}$ | 150° C. |
| III/34. | " | 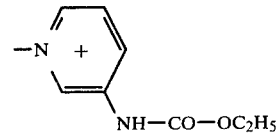 | $ClO_4^{\ominus}$ | 162–165° C. |

-continued
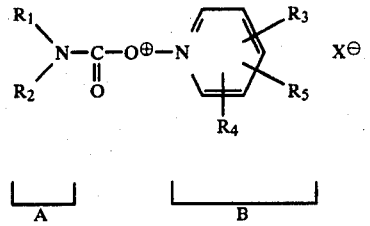
| subst.-No. | A | B | X⊖ | m.pt. decomp. |
|---|---|---|---|---|
| III/35. | " | 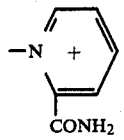 | $ClO_4^{\ominus}$ | 200° C. |
| III/36. | 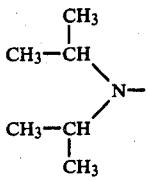 | 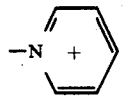 | $Cl^{\ominus}$ | 158° C. |
| III/37. | " | 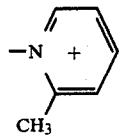 | $Cl^{\ominus}$ | 138° C. |
| III/38. | " | 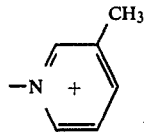 | $Cl^{\ominus}$ | 152–154° C. |
| III/39. | 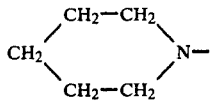 | 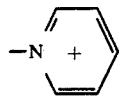 | $Cl^{\ominus}$ | 85–86° C. |
| III/40. | " | 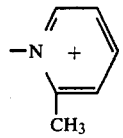 | $ClO_4^{\ominus}$ | 100° C. |
| III/41. | " | 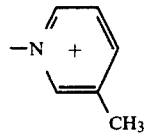 | $ClO_4^{\ominus}$ | 80° C. |
| III/42. | " | 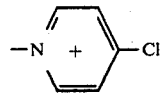 | $Cl^{\ominus}$ | 104–106° C. |
| III/43. | 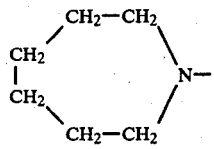 | 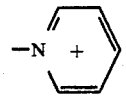 | $Cl^{\ominus}$ | 70–78° C. |

-continued

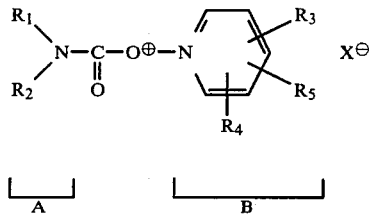

| subst.-No. | A | B | $X^{\ominus}$ | m.pt. decomp. |
|---|---|---|---|---|
| III/44. | 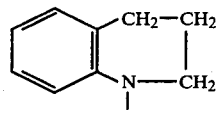 | " | $Cl^{\ominus}$ | 140–144° C. |
| III/45. | 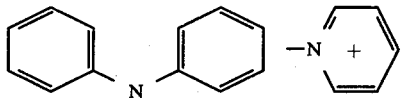 |  | $Cl^{\ominus}$ | 160–162° C. |
| III/46. | " | 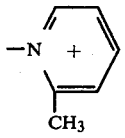 | $Cl^{\ominus}$ | 98–100° C. |
| III/47. | " | 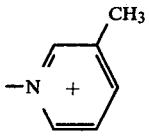 | $Cl^{\ominus}$ | 216–220° C. |
| III/48. | " | 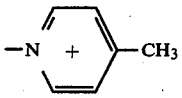 | $Cl^{\ominus}$ | 116° C. |
| III/49. | " | 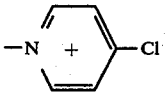 | $Cl^{\ominus}$ | 125–128° C. |
| III/50. | 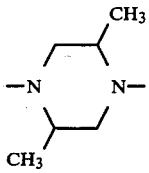 | 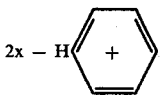 | 2 $Cl^{\ominus}$ | 109–112° C. |

The quick acting hardeners suitable for the process according to the present invention are known. Details concerning the preparation and properties thereof may be found in the following documents: Carbamoylpyridinium compounds have been described in British Pat. No. 1,383,630 and carbamoyloxypyridinium compounds in Belgian Patent No. 825,726.

The cyclic diketo compounds according to the present invention may be used together with the above-mentioned hardeners in the layers of photographic recording materials without the two additions having any deleterious effect on each other. The diketo compounds may be added to the casting solution of one of the partial layers or to the casting solutions of several partial layers of the photographic material, according to the conditions under which the layers are cast. It is generally sufficient to cover the recording material with a covering layer containing the diketo compound. This sufficiently protects the layer combination against the penetration of aldehyde vapours. Employment of the diketo compounds in this form have proved to be particularly suitable for colour photographic multilayered materials. Since the diketo compounds according to the present invention are capable of diffusion to some extent, the quantity of diketo compound applied with the covering layer may be calculated so that the compound which diffuses into the layer combination during the drying process will be uniformly distributed in those layers of the combination which contain the color components, so that optimum protection will be achieved.

The diketo compounds may be introduced as solutions in any water-miscible solvents or in water itself, depending on the solubility and capacity for crystallisation thereof. It is particularly advantageous to use low boiling solvents which may readily be removed when the photographic recording material has been cast, e.g. methanol, ethanol, propanol, t-butanol, acetone, methyl ethyl ketone or acetonitrile.

The quantity of cyclic diketo compounds required depends, of course, on the extent of protection required for the recording material. It will therefore depend on the aldehyde concentration to be expected, the sensitivity of the components within the photographic material to be protected and the solubility of the cyclic diketo compounds used. To protect colour photographic recording materials against damage in storage due to the aldehydes present in the atmosphere, it is generally sufficient to add at least 0.05 mol of the cyclic diketo compound per mol of hardener. It is preferred to use from 0.1 to 6 mol of diketo compound per mol of hardener, and quantities of from 0.2 to 2 mol of diketo compound per mol of hardener have been found to be particularly suitable.

The layer of the recording material may contain other hydrophilic colloids in addition to gelatine, including colloidal albumin, agar, gum arabic, dextrans, alginic acid, cellulose derivatives, e.g. up to an acetyl content of from 19 to 26% of hydrolysed cellulose acetate, polyacrylamides, imidatised polyacrylamides, zein, vinyl alcohol polymers having urethane/carboxylic acid groups or cyanoacetyl groups, such as vinyl alcohol, vinyl cyano acetate copolymers, polyvinyl alcohols, polyvinyl pyrrolidones, hydrolysed polyvinyl acetates, polymers of the type obtained from the polymerisation of proteins and saturated acylated proteins with monomers containing vinyl groups, polyvinyl amines, polyaminoethyl methacrylates and polyethylene imines.

Color photographic recording materials in which the cyclic diketo compounds according to the present invention may advantageously be used have been described, for example in German offenlegungsschrift Nos. 2,408,814; 2,625,026 and 2,517,408.

The cyclic diketo compounds used according to the present invention in conjunction with the carbamoylonium, carbamoylpyridinium and carbamoyloxypyridinium hardeners have proved to be particularly advantageous on account of the fact that they in no way impair the sensitometric properties od the photographic material although they would in principle be capable of coupling due to the presence of an active carbon atom. In contrast to the known aldehyde scavengers, however, they are highly reactive with aldehydes, and it is this characteristic which enables the abovementioned hardeners to be used.

The following Examples in which preferred embodiments of the present invention are described serve to illustrate the present invention in more detail. Percentages denote percentages, by weight, unless otherwise indicated.

EXAMPLE 1

The Examples which follow are based on the following arrangement of layers:

The layers described below are applied one after another to a cellulose triacetate support covered with an antihalation layer and an adhesive layer. The quantities given are based in each case on 1 $m^2$. The quantity of silver applied is expressed in terms of the corresponding quantity of silver nitrate.

The compounds indicated by letters of the alphabet in the description of the individual layers correspond to the following formula:

(A)

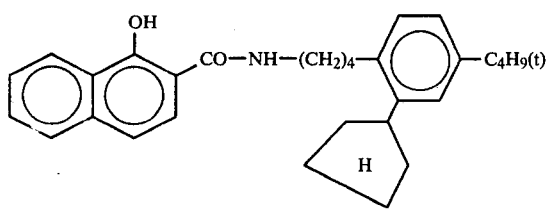

(B)

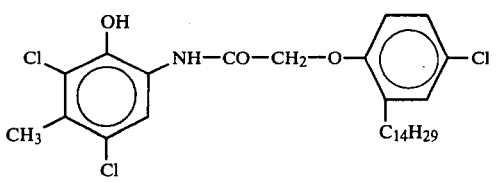

(C)

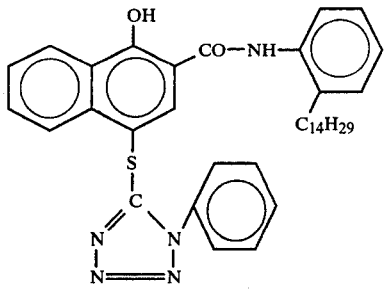

-continued
(D)
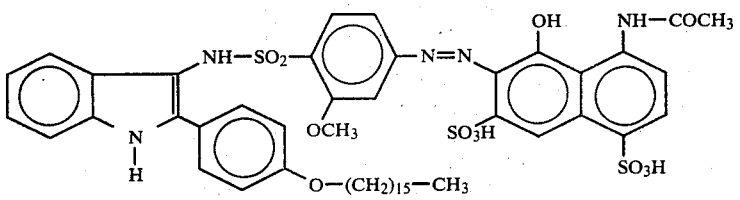
(E)
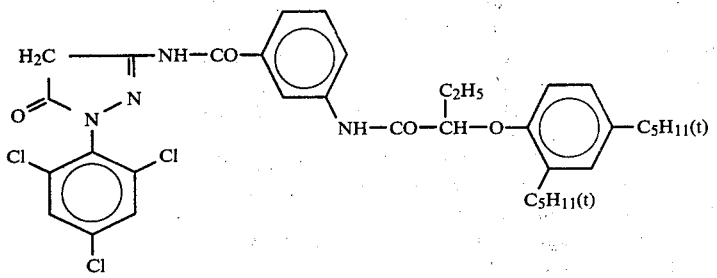
(F)
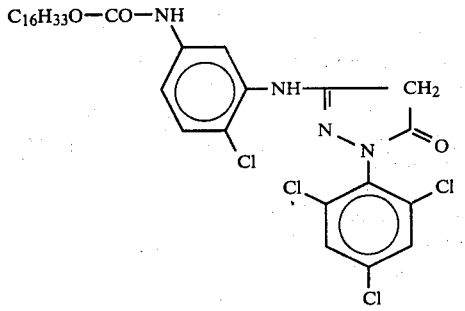
(G)
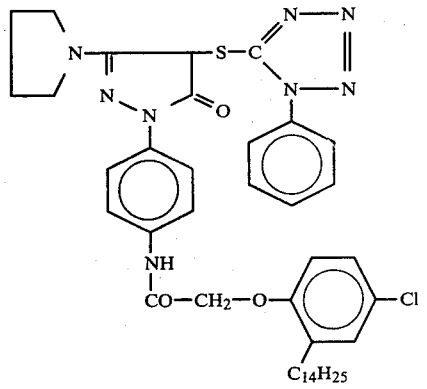
(H)
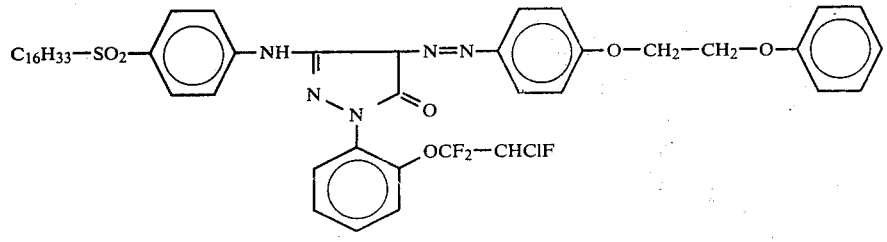

-continued (J)

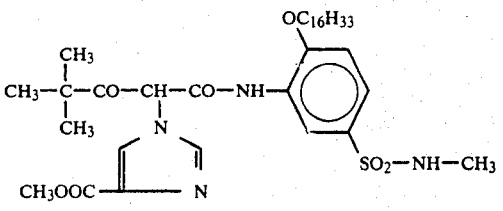

1. A comparatively low sensitivity layer of a red-sensitized silver iodobromide emulsion (5 mol-% AgI) consisting of 2.8 g of $AgNO_3$ and 2.5 g of gelatine in which are dispersed 0.7 g of cyan coupler of formula (A), 0.3 g of a cyan coupler of formula (B), 0.025 g of DIR coupler (C) and 0.075 g of the red mask (D).

2. A highly sensitive layer of a red-sensitized silver iodobromide emulsion (6 mol-% AgI) containing 1.9 g of $AgNO_3$, 2.0 g of gelatine, 0.21 g of cyan coupler (A) and 0.09 g of cyan coupler (B).

3. An intermediate layer of 0.7 g of gelatine.

4. A less sensitive layer of a green-sensitized silver iodobromide emulsion (6 mol-% Ag) containing 2.3 g of $AgNO_3$, 2.6 g of gelatine and, dispersed therein, 0.3 g of color coupler of formula (E), 0.3 g of color coupler of formula (F), 0.06 g of DIR coupler (G) and 0.09 g of yellow masking coupler (H).

5. A highly sensitive layer of a green-sensitized silver iodobromide emulsion (6 mol-% AgI) containing 2.6 g of $AgNO_3$, 2.2 g of gelatine and 0.25 g of color coupler of formula (E) dispersed therein.

6. An intermediate layer of 1.0 g of gelatine.

7. A Carey Lea silver filter layer having a color density of 0.7 with a gelatine application of 1.0 g per $m^2$.

8. A less sensitive blue-sensitized layer (5 mol-% AgI) containing 0.95 g of $AgNO_3$, 2.0 g of gelatine and 1.6 g of yellow coupler of formula (J) dispersed therein.

9. A highly sensitive blue-sensitized layer (6 mol-% AgI) containing 0.5 g of $AgNO_3$, 1.0 g of gelatine and 0.1 g of yellow coupler (J) dispersed therein.

10. A covering layer of 1.2 g of gelatine.

11. A covering layer of 0.25 g of gelatine with which 3.3 mMol of the carbamoylpyridinium or carbamoyloxypyridinium salts described below have been introduced into the layer combination.

Samples of a film built up as described above are exposed behind a gradually stepped wedge and after development with N-ethyl-N-β-hydroxyethyl-3-methyl-p-phenylenediamine (3¼ minutes at 38° C.), followed by bleach fixing (see the process described by Ernest Ch. Gehret in British Journal of Photography, 1974, page 597) the samples are examined for sensitometric properties.

To test the resistance thereof to aldehydes, samples measuring 35×250 mm were kept for 7 days at room temperature in a vessel of 27 l capacity containing a mixture of 650 g of glycerol, 350 g of water and 1 ml of 30% formaldehyde, and the samples were then compared with material which had been stored under normal conditions. The results were assessed in terms of the magenta residual color density remaining as a percentage of the color density 1.5 above the fog.

EXAMPLE 2

Diketo compound No. 25 was introduced in the form of a 2.5% aqueous solution at pH 6 into the casting solution of layer 10 of Example 1. Compound No. III/39 was used as hardener. The results are shown in Table 1 below.

TABLE 1

| Diketo compound No. 25 mg/$m^2$ | Residual colour density magenta |
|---|---|
| 0 | 65% |
| 100 | 72% |
| 250 | 82% |
| 400 | 88% |
| 550 | 98% |

The results show that 550 mg of the diketo compound are sufficient to produce virtually complete protection against formalin.

Analogous results are obtained when compounds I/12, II/10 and III/13 are used as hardeners instead of compound No. III/39.

EXAMPLE 3

The effect of the 1,3-diketo compounds is compared with that of known aldehyde-scavengers. Both the diketo compounds and the comparison compounds were added in quantities of 170 mg to layer 7 of Example 1, 180 mg to layer 8 of Example 1 and 100 mg to layer 9 of Example 1. Compound II/15 was used as hardener.

Table 2 shows that the cyclic 1,3-diketo compounds according to the present invention are virtually the only compounds which have any protective action.

TABLE 2

| Aldehyde-scavenger | Aldehyde-scavenger (%, by weight) in solvent pH = 6 | Residual colour density magenta |
|---|---|---|
| 1 | 10% in water/ethanol = 1/1 | 84% |
| 2 | 10% in water/ethanol = 1/1 | 84% |
| 7 | 5% in water | 80% |
| 16 | 4% in water | 72% |
| 20 | 5% in water | 82% |
| 23 | 10% in ethanol | 70% |
| 25 | 2.5% in water | 87% |
| none | — | 55% |
| Ethylenediurea | 10% in water | 58% |
| Semicarbazide | 10% in water | 56% |
| Hydroxylamine | 10% in water | 56% |
| Acetylacetone | 10% in water | 54% |

EXAMPLE 4

Diketo compound No. 26 is used to add 22 0 g thereof to layers 1 and 2 of Example 1 and 145 mg to layers 7,8 and 9 of Example 1. The hardener used is in all cases No. II/10. The magenta colour density was found to be 90% in all 5 samples after storage in a formalin atmosphere. The Example demonstrates that the protection action acheived is the same regardless of whether the diketo compound is incorporated in a layer above or below the magenta layer to be protected or in the magenta layer itself.

We claim:

1. Light-sensitive color photographic silver halide recording material consisting of a layer support and applied to this layer at least one light-sensitive gelatine-containing layer containing color couplers for the formation of the image dyes in the three primary colors, a cross-linking agent which activates the carboxyl groups of the gelatine and a compound acting as aldehyde-scavenger, characterised in that the cross-linking agent which activates the carboxyl groups of gelatine is a gelatine hardener selected from carbamoylonium salts, carbamoylpridinium salts and carbamoyloxypyridinium salts, and the compound acting as aldehyde-scavenger corresponds to the following general formula:

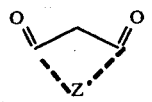

wherein Z represents the atoms required for completing a 5- or 6-membered, substituted or unsubstituted carbocyclic ring or a substituted or unsubstituted heterocyclic ring which may contain oxygen, nitrogen or sulfur as heteroatom.

2. Material according to claim 1, characterised in that the compound acting as aldehyde-scavenger is selected from cyclopentane-1,3-diones, cyclohexane-1,3-diones, pyran-2,4-diones, dihydropyran-2,4-diones, thiopyran-2,4-diones, dioxa-cyclohexane-2,4-diones, tetrahydropyrimidine-2,4-diones and 2,4,6-trioxohexahydropyrimidines, in which compounds the ring carbon atoms may be substituted with straight- or branched-chain alkyl groups having from 1 to 5 carbon atoms or carry a condensed cycloaliphatic or aromatic 6-membered ring or an aliphatic 5- or 6-membered ring in spiro-linkage.

3. Material according to claim 1, characterised in that in the general formula of said aldehyde-scavenger the total number of carbon atoms of the substituents in the ring carrying the two keto groups is not greater than 6.

4. Material according to claims 1, 2 or 3, characterised in that said gelatine hardener is a carbamoylpyridinium sulfonic acid betaine and said aldehyde-scavenger is a tetrahydropyrimidine-2,4-dione.

5. Material according to claim 1, characterised in that said gelatin hardener is of the following formula

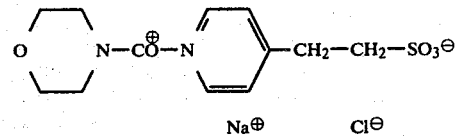

and said aldehyde-scavenger is 1-methyl-2,4,6-trioxohexahydropyrimidine.

* * * * *